US007439689B2

(12) United States Patent
Honda et al.

(10) Patent No.: US 7,439,689 B2
(45) Date of Patent: Oct. 21, 2008

(54) LAMP DRIVING DEVICE HAVING IMPEDANCE COMPONENT DETECTING ABNORMAL DISCHARGE

(75) Inventors: Hirofumi Honda, Gunma (JP); Shinichi Ishida, Gunma (JP); Tatsuya Sakurai, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 11/521,867

(22) Filed: Sep. 15, 2006

(65) Prior Publication Data

US 2007/0069661 A1 Mar. 29, 2007

(30) Foreign Application Priority Data

Sep. 16, 2005 (JP) ..... 2005-270925

(51) Int. Cl.
*G05F 1/00* (2006.01)

(52) U.S. Cl. ..... 315/307; 315/291; 315/274; 315/312; 315/224

(58) Field of Classification Search ..... 315/291, 315/307, 312, 316, 324, 325, 297, 224, 225, 315/274
See application file for complete search history.

(56) References Cited

U.S. PATENT DOCUMENTS

| | | | | |
|---|---|---|---|---|
| 6,949,893 | B2 * | 9/2005 | Higuchi | 315/312 |
| 2004/0217719 | A1 * | 11/2004 | Higuchi | 315/312 |
| 2004/0251851 | A1 * | 12/2004 | Maishima | 315/244 |
| 2006/0038513 | A1 * | 2/2006 | Henry | 315/291 |

FOREIGN PATENT DOCUMENTS

| | | |
|---|---|---|
| JP | 3123161 | 10/2000 |
| JP | 2002-151287 | 5/2002 |
| JP | 2004-135489 | 4/2004 |

* cited by examiner

*Primary Examiner*—Tuyet Vo
(74) *Attorney, Agent, or Firm*—Knobbe Martens Olson & Bear LLP

(57) ABSTRACT

In one aspect, an impedance component which exhibits a high impedance in a high frequency region is arranged on a high pressure line formed on a secondary side of a transformer. The potential difference generated at both ends of the impedance component is used to detect an abnormal electrical discharge generated in the high pressure line. When the abnormal electrical discharge is detected, a switching operation is stopped by a controlling circuit, whereby a protection operation is performed.

5 Claims, 14 Drawing Sheets

LAMP DRIVING DEVICE HAVING IMPEDANCE COMPONENT DETECTING ABNORMAL DISCHARGE

BACKGROUND OF THE INVENTION

1. Field of the Invention

The present invention relates to a lamp driving device and, more specifically, to a lamp driving device which is effective for detecting an abnormal electrical discharge.

2. Description of the Related Technology

In the lamp driving device that illuminates a lamp upon generation of high voltage, there is a case in which the abnormal electrical discharge due to bad electrical contact of a transformer or the lamp. Since the abnormal electrical discharge of this type may cause smoking or ignition, it is necessary to stop a lighting operation in case of abnormal electrical discharge.

Several methods of detecting the abnormal electrical discharge and stopping the operation are disclosed, for example, in Japanese Patent No. 3123161, JP-A-2002-151287 and JP-A-2004-135489.

Japanese Patent No. 3123161 discloses a method of detecting the abnormal electrical discharge using a capacitor as shown in FIG. 1 in the same document, JP-A-2002-151287 discloses a method of detecting the abnormal electrical discharge using a high-pass filter as shown in FIG. 2 in the same document, and JP-A-2004-135489 discloses a method of detecting the abnormal electrical discharge using a flux variation.

However, with the methods shown in Japanese Patent No. 3123161 and JP-A-2002-151287, since a resistor for voltage transduction of signals detected by the capacitor or the high-pass filter is necessary, the number of parts increases. With these methods, signal components at high frequency are detected substantially the entire region, for example, malfunction may be resulted due to the influence of mobile phones.

In the method disclosed in JP-A-2004-135489, since wiring design for performing magnetic flux detection is necessary, the freedom degree of wiring on a substrate is reduced, and selectivity of frequency is not good. Therefore, there is a possibility of malfunction due to the influence of the mobile phone as in the cases of Japanese Patent No. 3123161 and JP-A-2002-151287.

There is a problem common to these three patent documents that even when noise elements other than the abnormal electrical discharge, for example, electrostatic discharge is occurred, the noise elements pass through the capacitor and the high-pass filter, and hence the operation may be stopped under the circumstances in which the operation should not be stopped.

SUMMARY OF CERTAIN INVENTIVE ASPECTS

The system, method, and devices of the invention each have several aspects, no single one of which is solely responsible for its desirable attributes. Without limiting the scope of this invention, its more prominent features will now be briefly discussed.

Accordingly, it is an object of certain inventive aspects to provide a method of detecting an abnormal electrical discharge which is effective for discrimination between the abnormal electrical discharge and other noises, and is superior in noise performance.

In order to achieve the object described above, a first aspect of the invention is a lamp driving device having a secondary closed-loop formed on the secondary side of the transformer, and a lamp arranged on the closed-loop in series configuration, including an impedance component arranged on the closed-loop in series configuration, a unit that detects a potential difference generated at both ends of the impedance component, and a unit that carries out a protection operation on the basis of the detected potential difference.

In this manner, with the utilization of the potential difference at both ends of the impedance component arranged on the closed-loop on the secondary side of the transformer in series configuration, a resistor for current-voltage conversion is not necessary as in a capacitor system in the related art. Consequently, the lamp driving device in which the number of parts is reduced can be provided.

A second aspect of the invention is a lamp driving device having an AC power supply connected to a primary side of a transformer, a secondary closed-loop formed on a secondary side of the transformer, and a lamp arranged on the closed-loop in series configuration, wherein an impedance component having a high impedance value is arranged in the closed-loop in a high impedance region higher than an impedance value of a frequency of an electrical current supplied from the AC power supply to the lamp, so that an abnormal electrical discharge of the lamp is detected using the high impedance region of the impedance component.

In this manner, with the utilization of the impedance component having a low impedance characteristic at a frequency of the lamp driving current, and a high impedance characteristic at higher frequencies, abnormal electrical discharge elements which exist in a specific frequency band can be detected preferably.

A third aspect of the invention provides a lamp driving device having a secondary closed-loop formed on, a secondary side of a transformer, and a lamp arranged on the closed-loop in series configuration, wherein a plurality of impedance components whose impedance values increase in frequency region different from each other are arranged in the closed-loop to detect an abnormal electrical discharge of the lamp using high impedance regions of the respective impedance components.

In this manner, with the utilization of the high impedance regions of the plurality of impedance components having the frequency characteristics different from each other respectively, signal components existing in the plurality of frequency regions can be detected, and detection avoiding noise elements which are desired to be excluded from the detection object is achieved. Therefore, a highly reliable protection mechanism in which malfunction due to noises can be provided.

A fourth aspect of the invention is a lamp driving device having a secondary closed-loop formed on a secondary side of a transformer, and a lamp arranged on the closed-loop in series configuration, including an impedance component unit in which first and second impedance components are arranged on the closed-loop in adjacent to each other in series configuration, a unit that detects a potential difference generated at both ends of the impedance component unit, and a unit that carries out a protection operation on the basis of the detected potential difference.

In this manner, since the impedance component unit is configured by connecting two or more impedance components in cascade that detects the potential difference at the both ends of the impedance component unit, so that the respective impedance components can detect signal components existing in a frequency region where impedance components exhibit high impedances, a high selectivity is achieved, and a wide frequency region can be covered as a detection object.

A fifth aspect of the invention is a lamp driving device having a secondary closed-loop formed on a secondary side of a transformer, and a lamp arranged on the closed-loop in series configuration, including first and second impedance components arranged on closed-loop in series configuration, a unit that detects a potential at a node between the first impedance component and the second impedance component, and a unit that carries out a protection operation on the basis of the detected potential difference.

In this manner, by detecting the potential at the node between two or more impedance components, a frequency at which one of the impedance components exhibits a high impedance can be determined as a detection object, and a frequency at which the other impedance component exhibits a high impedance can be determined not to be the detection object. Therefore, a sensing mechanism with higher selectivity can be provided.

A sixth aspect of the invention is a lamp driving device having a secondary closed-loop formed on a secondary side of a transformer, and a lamp arranged on the closed-loop in series configuration, including a plurality of impedance components arranged on the closed-loop in series configuration, a unit that detects a potential difference generated at both ends of the respective impedance components, a unit that obtains a logical product of the detected respective potential differences, and a unit that carries out a protection operation using the obtained logical product.

In this manner by obtaining the logical product of the potential differences at the ends of the two or more impedance components, a signal component having a spectrum at all the frequencies at which the respective impedance components exhibit high impedances can be detected. Consequently, a static electricity noise and an abnormal electrical discharge can be discriminated.

A seventh aspect of the invention is a lamp driving device having a secondary closed-loop formed on a secondary side of a transformer, and a lamp arranged on the closed-loop in series configuration, including a plurality of impedance components arranged on the closed-loop in series configuration, a unit that detects potential differences generated at both ends of the respective impedance components, a unit that obtains a logical product of the detected respective potential differences, and a unit that carries out a protection operation using the obtained logical product.

In this manner, by utilizing the logical product of the potential differences at the both ends of the two or more impedance components, a signal component having a spectrum over a wide range of frequency and a signal component having a spectrum at a certain specific frequency can be discriminated. For example, an abnormal electrical discharge having the spectrum over a wide range of frequency can be discriminated from a static electricity noise which is generated at each electrical discharge at random frequencies. Consequently, a highly reliable sensing mechanism without malfunction can be provided.

An eighth aspect of the invention is a lamp driving device having a secondary closed-loop formed on a secondary side of a transformer, a lamp arranged on the closed-loop in series configuration, a lighting control unit that controls lighting of the lamp, and a protection circuit that detects an abnormality of the closed-loop and gives an instruction to stop a lighting operation to the lighting control unit, including an impedance component arranged on the closed-loop in series configuration, and a unit that detects a potential difference generated at both ends of the impedance component, wherein the protection circuit generates an output signal to the lighting control unit on the basis of the detected potential difference.

In this manner, when an abnormality is detected on the secondary closed-loop, the lighting operation of the lamp is stopped via the lighting control unit, and a desirable protection operation is carried out even when an abnormal electrical discharge is occurred.

In certain inventive aspects, the impedance component to be arranged on the secondary closed-loop is preferably a component having a low impedance characteristic for a frequency of the lamp driving current and a high impedance characteristic for frequencies of the signal components such as the abnormal electrical discharge to be detected for preventing loss of the lamp driving current.

As an example of such a component, for example, ferrite beads whose impedance is low at the lamp driving frequency and increases abruptly at the frequency near 200 MHz to 500 MHz can be used.

As described above, according to certain inventive aspects, a lamp driving device which is effective for discriminating the abnormal electrical discharge element from the noise element, and hence is superior in noise performance is provided.

BRIEF DESCRIPTION OF THE DRAWINGS

FIGS. 2A and 2B are characteristic drawings showing a current waveform of a current flowing in a high pressure line in the normal state and a current waveform when an abnormal electrical discharge is occurred;

FIGS. 6A and 6B are characteristic drawings showing waveforms generated at respective points in the lamp driving device shown in FIG. 5;

DETAILED DESCRIPTION OF CERTAIN EMBODIMENTS

Figure 1:
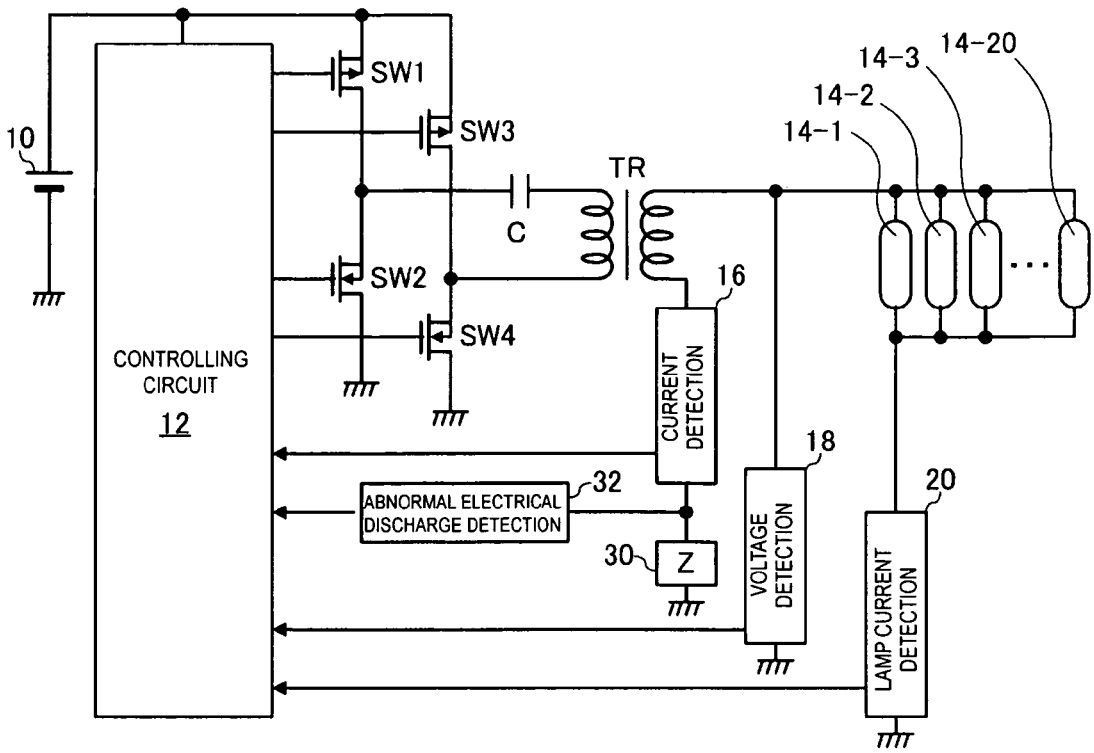
FIG. 1 is a circuit block diagram showing a configuration of a lamp driving device according to an embodiment of the invention.

Various aspects and features of the invention will become more fully apparent from the following description and appended claims taken in conjunction with the foregoing drawings. In the drawings, like reference numerals indicate identical or functionally similar elements. In the following description, specific details are given to provide a thorough understanding of the disclosed methods and apparatus. However, it will be understood by one of ordinary skill in the technology that the disclosed systems and methods may be practiced without these specific details. For example, electrical components may be shown in block diagrams in order not to obscure certain aspects in unnecessary detail. In other instances, such components, other structures and techniques may be shown in detail to further explain certain aspects.

Referring now to the attached drawings, a lamp driving device according to the invention will be described. The invention is not limited to the embodiment shown below and can be modified as needed.

FIG. 1 is a circuit block diagram showing a configuration of the lamp driving device according to an embodiment of the invention. The lamp driving device shown as an example in FIG. 1 is a full bridge inverter unit that illuminates a plurality of lamps and has a multi light control structure including a controlling circuit and a transformer.

As shown in FIG. 1, a direct-current power supply 10 is connected to a full bridge circuit including switching devices SW1 to SW4, and a transformer TR is connected to a downstream of the full bridge circuit via a capacitor C, whereby an inverter circuit that outputs a high voltage power from a secondary side of the transformer TR. The downstream of the secondary side of the transformer TR is referred to as a high pressure line. A line which is connected to the secondary side of the transformer TR and fed back to the controlling circuit is also referred to as the high pressure line for convenience. Since the structure and the operation of the inverter circuit are known technologies, description will not be made in this embodiment.

Twenty lamps 14-1 to 14-20 are connected in parallel to the high pressure line in downstream of the inverter circuit, and a current detection circuit 16 that detects the amount of electrical current flowing in the high pressure line, and a voltage detection circuit 18 that detects a voltage value applied to the high pressure line are arranged between a secondary winding of the transformer TR and a GND.

A lamp current detection circuit 20 that detects the total amount of electrical current of the lamps is arranged between the lamps 14-1 to 14-20 and the GND, and the detected result of the lamp current detection circuit 20 is outputted to a controlling circuit 12. The controlling circuit 12 controls the switching devices SW1 to SW4 on the basis of the output from the lamp current detection circuit 20, and performs a constant current feedback control that maintains the electrical current flowing in the lamps 14-1 to 14-20 constant.

The controlling circuit 12 acquires the detected result of the current detection circuit 16 and compares the same with a predetermined reference and, when the detected result exceeds the reference, performs overcurrent protection. The controlling circuit 12 acquires the detected result of the voltage detection circuit 18 and compares the same with a predetermined reference and, when the detected result exceeds the reference, performs overvoltage protection.

The controlling circuit 12 carries out a protection operation upon an abnormal electrical discharge detection using an impedance component 30 and an abnormal electrical discharge detection circuit 32 in addition to the above-described overcurrent protection and overvoltage protection. The impedance component 30 is arranged on the high pressure line formed on the secondary side of the transformer TR in series configuration, the abnormal electrical discharge detection circuit 32 detects a potential difference generated by the impedance component 30, and the controlling circuit 12 performs the protection operation for the abnormal electrical discharge on the basis of the detected result.

Figure 2A:
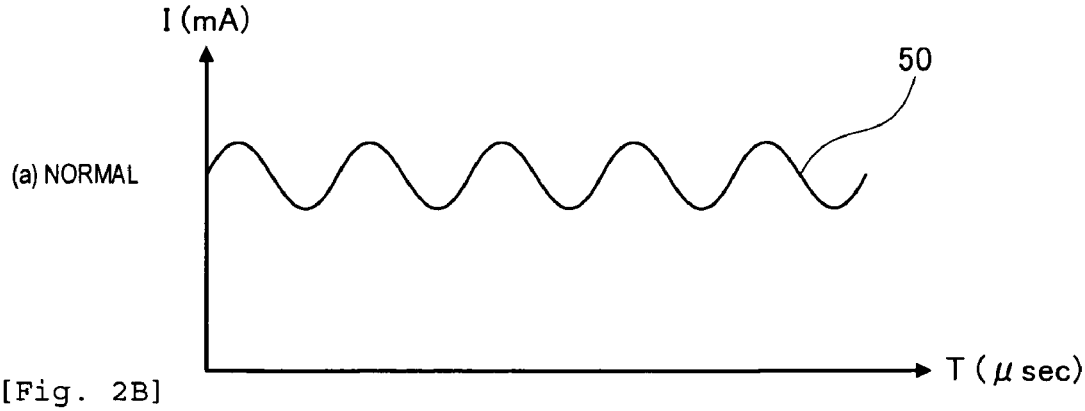
Figure 2A:
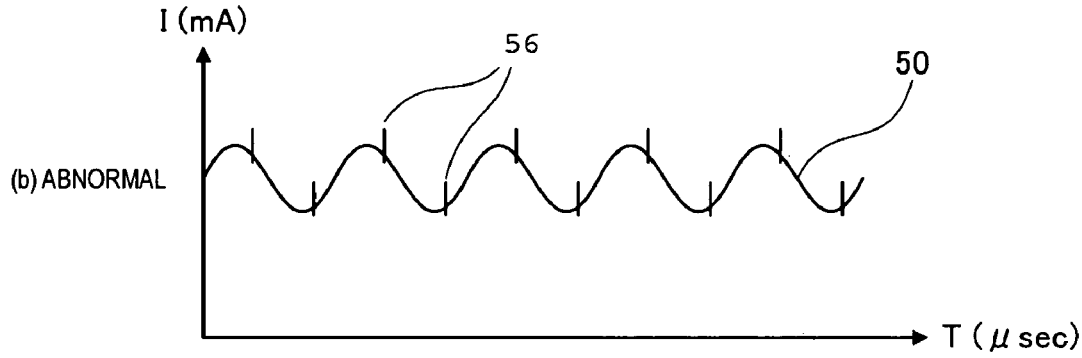

FIGS. 2A and 2B are characteristic drawings showing a current waveform of a current flowing in the high pressure line in the normal state and a current waveform when the abnormal electrical discharge is occurred. As shown in FIG. 2A, in the normal state when the abnormal electrical discharge is not occurred, a lamp current 50 flowing in the lamp exhibits an alternating current waveform of 100 kHz or lower. On the other hand, as shown in FIG. 2B, when the abnormal electrical discharge is occurred in the high pressure line, a current waveform in which abnormal electrical discharge elements 56 of several tens MHz or higher are superimposed cyclically or at random to the lamp current 50 of 100 kHz or lower can be obtained.

Figure 3:
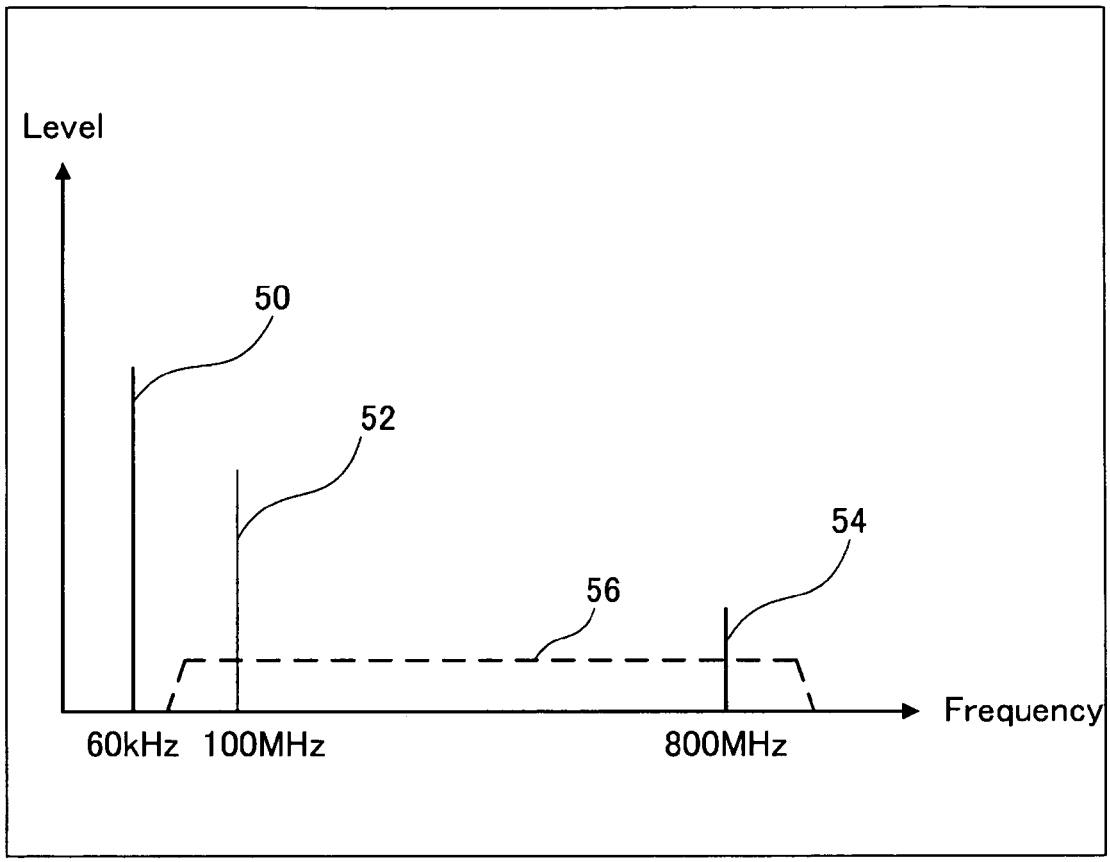
FIG. 3 is a conceptual drawing showing frequency characteristics of a lamp current element, an abnormal electrical discharge element, and other noise elements.

FIG. 3 is a conceptual drawing showing an example of frequency characteristics of a lamp current element, the abnormal electrical discharge element, and other noise elements. As shown in FIG. 3, for example, the frequency spectrum of the lamp current 50 exists in a low frequency region of 60 kHz or lower, and the frequency spectrum of the static electricity noise 52 exists, for example, at 100 MHz. A noise element 54 generated by a mobile phone exists, for example, at 800 MHz, and an abnormal electrical discharge element 56 has a wide spectral distribution over a range of several MHz to several hundreds MHz.

Figure 4:
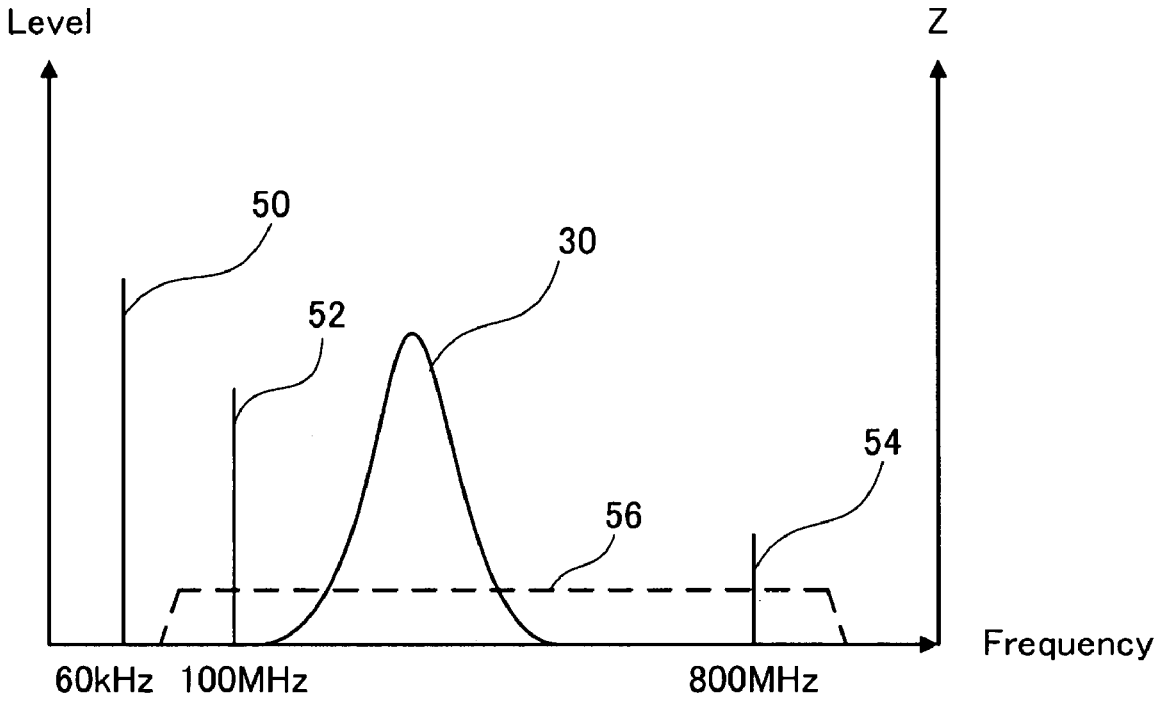
FIG. 4 is a conceptual drawing showing a relation between the abnormal electrical discharge element and the frequency characteristics of an impedance component.

FIG. 4 is a conceptual drawing showing a relation between the abnormal electrical discharge element and the frequency characteristics of the impedance component. As shown in FIG. 4, the abnormal electrical discharge element 56 can be selectively detected by using a component such as beads or inductors whose impedance increases at a frequency characteristic of about 200 MHz to 500 MHz as an impedance component 30.

Figure 5:
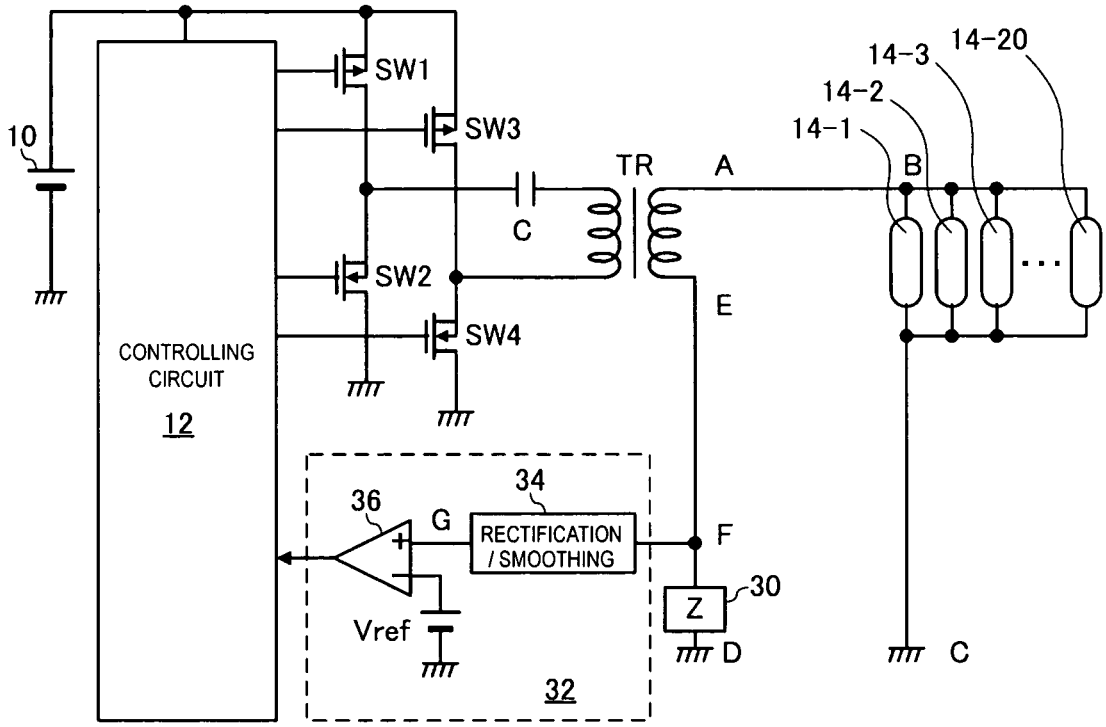
FIG. 5 is a circuit block diagram showing a configuration of the lamp driving device according to a second embodiment.

FIG. 5 is a circuit block diagram showing a configuration of the lamp driving device according to a second embodiment. The lamp driving device shown in FIG. 5 is an embodied example of a configuration of the abnormal electrical discharge detection circuit 32 with the detection circuits 16, 18 and 20 in FIG. 1 omitted. Other configurations are the same as in FIG. 1.

As shown in FIG. 5, the abnormal electrical discharge detection circuit 32 includes a rectification/smoothing circuit 34 that rectifies and smoothes the voltage waveform outputted as a potential difference of both ends of the impedance component 30 and a comparator 36 that compares a voltage value after the rectification and smoothing with a predetermined threshold value Vref, and the controlling circuit 12 determines that the abnormal electrical discharge is occurred when an output voltage value of the rectification/smoothing circuit 34 reaches or exceeds the threshold value Vref, and stops a switching operation.

In the lamp driving device shown in FIG. 5, an electrical current flowing in the lamp flows in the order of A→B→C→D→E→A . . . and this electrical current also flows in the reverse order since it is an alternating current. The impedance component 30 is arranged in series configuration on a loop of this A→B→C→D→E→A→ . . . , and presence or absence of generation of the abnormal electrical discharge is determined by detecting the potential difference across the impedance component 30.

Figure 6A:
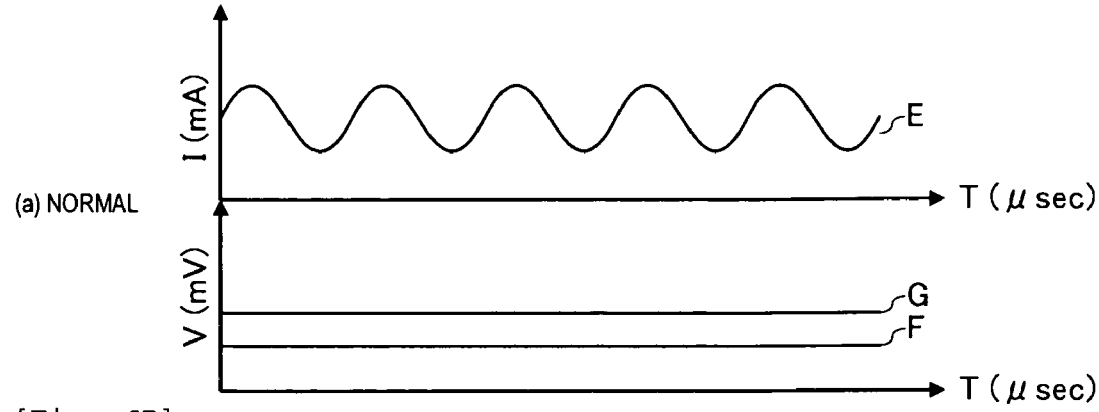
Figure 6A:
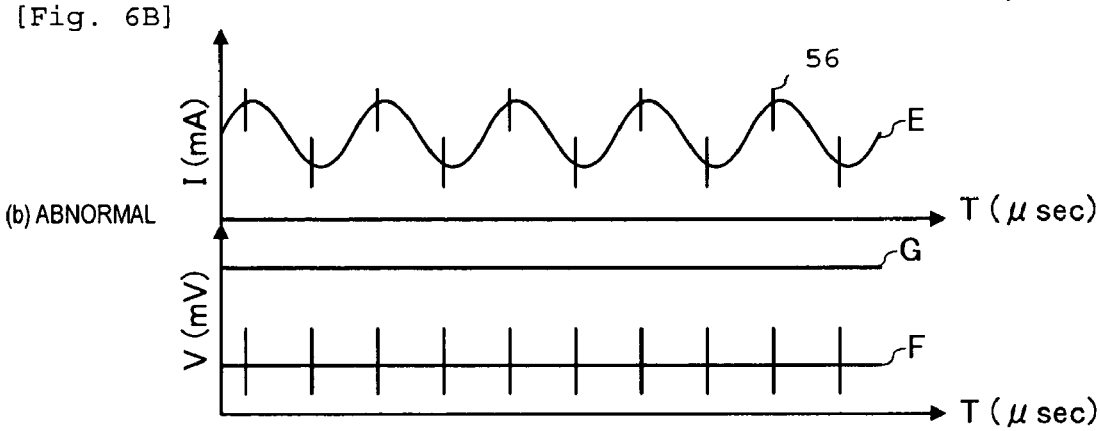

FIGS. 6A and 6B are characteristic drawings showing waveforms generated at respective points in the lamp driving device shown in FIG. 5. As shown in the respective drawings, waveforms shown in FIG. 6A are outputted at a point E, a point F and a point G in FIG. 5 in the state of normal operation, and waveforms shown in FIG. 6B are outputted in case of abnormal electrical discharge.

In this embodiment, since ferrite beads whose impedance increases of about 200 MHz to 500 MHz as shown in FIG. 4 are used as the impedance component 30, a voltage at the point F becomes a voltage having a large peak at which the abnormal electrical discharge element 56 is large as shown in FIG. 4(B), and as a consequence of the rectification/smoothing of this voltage, a potential at the point G increases. When the potential at the point G exceeds the threshold value Vref, it is determined to be generation of the abnormal electrical discharge and the operation of the inverter is stopped.

In this manner, in this embodiment, since an abnormal electrical discharge noise in a frequency band of about 200 MHz to 500 MHz can be selectively detected, malfunction due to other noises such as the mobile phone or the like other than the corresponding frequency can be prevented. In order to change the level of the detecting voltage or the detection frequency, it can be achieved easily by changing the impedance characteristic or the frequency characteristic of the ferrite beads.

Figure 7:
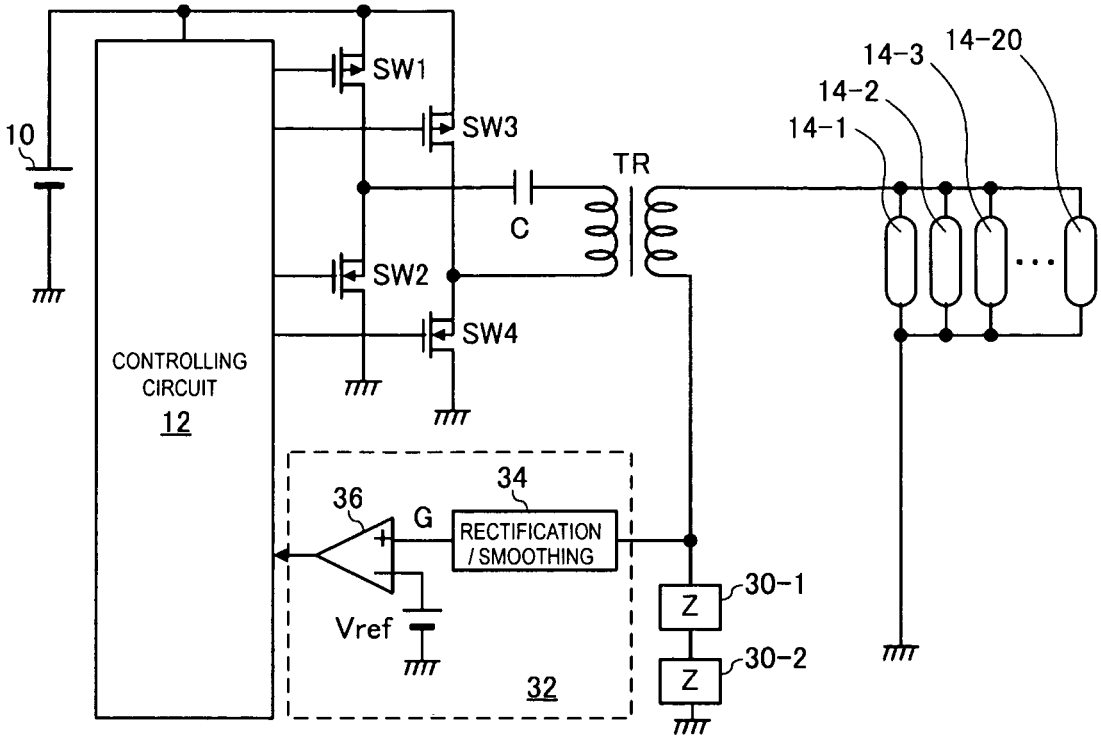
FIG. 7 is a circuit block diagram showing a configuration of the lamp driving device according to a third embodiment.

FIG. 7 is a circuit block diagram showing a configuration of the lamp driving device according to a third embodiment. The lamp driving device shown in FIG. 7 is an example of the configuration when a plurality of impedance components having different characteristic are used. Other configurations are the same as in FIG. 5. The lamp driving device configures an abnormal electrical discharge detection unit by arranging impedance components 30-1 and 30-2 being different in frequency characteristic from each other in series configuration as shown in the same drawing.

Figure 8:
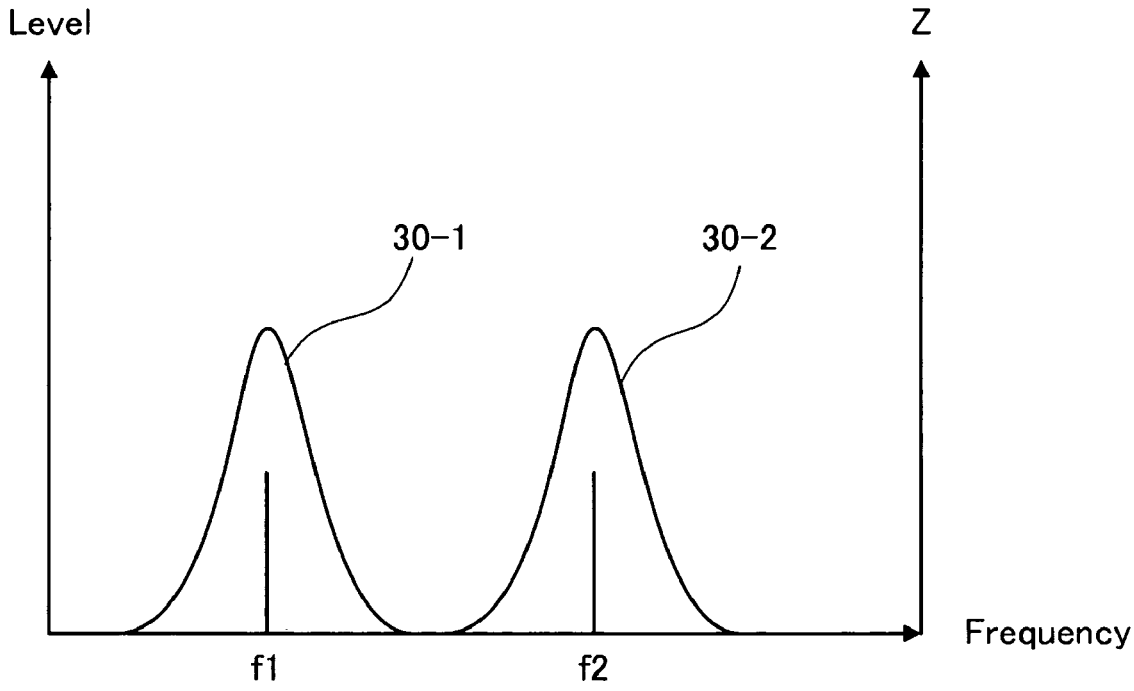
FIG. 8 is a characteristic drawing showing the frequency characteristics of impedance components 30-1 and 30-2 shown in FIG. 7.

FIG. 8 is a characteristic drawing showing the frequency characteristics of the impedance components 30-1 and 30-2 shown in FIG. 7. As shown in FIG. 8, in this embodiment, when one of an element near a frequency f1 generated in a high impedance region of the impedance component 30-1 and an element near a frequency f2 generated in a high impedance region of the impedance component 30-2 is detected, a protection operation is carried out. When widening of a frequency region which to be detected is wanted, third and fourth impedance components whose frequency to be detected is a high impedance may be added and arranged in series configuration.

This configuration is effective when malfunction due to a noise having a frequency characteristic between the frequency f1 and the frequency f2 is desired to be avoided, or when malfunction due to a frequency lower than the frequency f1 and a frequency higher than the frequency f2 is desired to be avoided.

Figure 9:
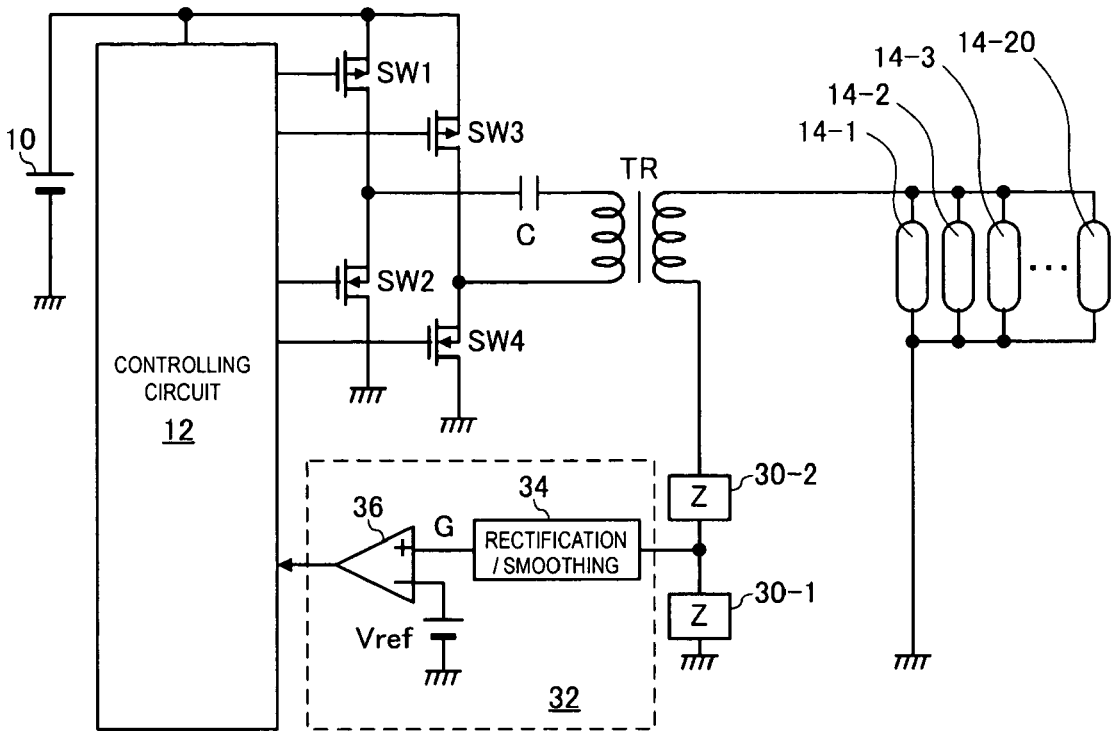
FIG. 9 is a circuit block diagram showing a configuration of the lamp driving device according to a fourth embodiment.

FIG. 9 is a circuit block diagram showing a configuration of the lamp driving device according to a fourth embodiment. The lamp driving device shown in FIG. 9 is an example having a configuration that detects the abnormal electrical discharge using a potential between impedance components being different in characteristic. Other configurations are the same as in FIG. 7. In the lamp driving device, as shown in FIG. 9, the impedance components 30-1 and 30-2 being different in frequency characteristic from each other are arranged in series configuration, and the potential between the impedance components is supplied to the abnormal electrical discharge detection circuit 32.

Figure 10:
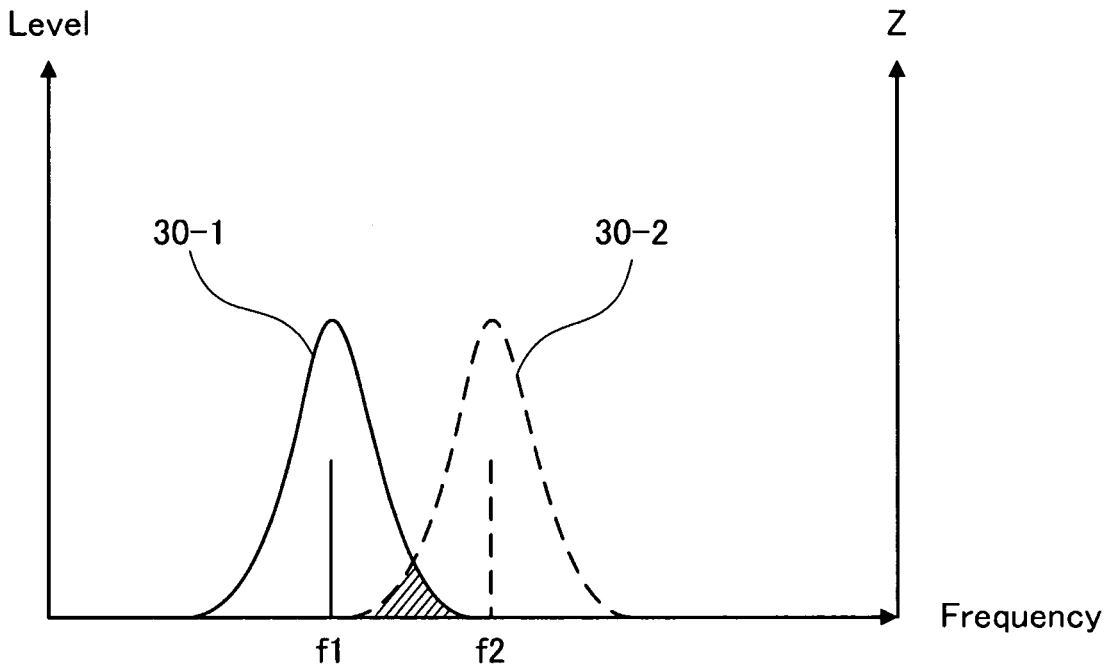
FIG. 10 is a characteristic drawing showing frequency characteristics of the impedance components 30-1 and 30-2 shown in FIG. 9.

FIG. 10 is a characteristic drawing showing frequency characteristics of the impedance components 30-1 and 30-2 shown in FIG. 9. As shown in FIG. 10, in this embodiment, the element near the frequency f1 generated in the high impedance region of the impedance component 30-1 shown by a solid line is detected, and the element near the frequency f2 generated in the high impedance region of the impedance component 30-2 shown by a broken line is shut down.

This configuration is effective when malfunction due to the noise element of the frequency f2 is desired to be avoided while detecting the element of the frequency f1.

Figure 11:
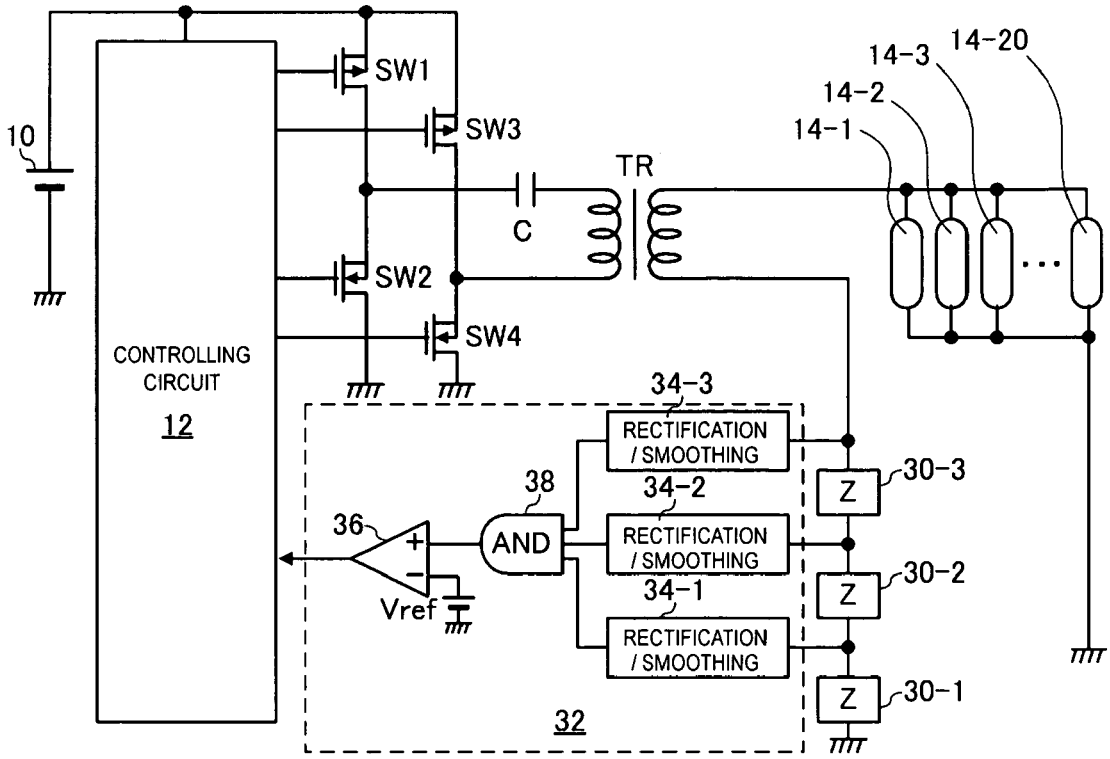
FIG. 11 is a circuit block diagram showing a configuration of the lamp driving device according to a fifth embodiment.

FIG. 11 is a circuit block diagram showing a configuration of the lamp driving device according to a fifth embodiment. The lamp driving device shown in FIG. 11 has a configuration effective for discriminating the abnormal electrical discharge and a static electricity noise, and other configurations are the same as in FIG. 7.

In the lamp driving device in this embodiment, the impedance components 30-1, 30-2 and 30-3 being different in frequency characteristics from each other are arranged in series configuration as shown in FIG. 11, and a potential difference generated between among these impedance components are rectified and smoothed by rectification/smoothing circuits 34-1, 34-2 and 34-3 respectively and a logical product of these values is obtained by an AND computing unit 38, whereby the abnormal electrical discharge element over a wide range is detected.

In this case, since the static electricity noise is generated in one-shot, the frequency thereof is not fixed. However, a generated spectrum thereof is limited to a narrowband. Therefore, although a voltage is generated in all the impedance components 30-1, 30-2 and 30-3 when the abnormal electrical discharge is occurred, the voltage is not generated in all the components in the case of the static electricity noise. In other words, in this configuration, a protection operation is not carried out unless a noise is detected in a wide frequency band.

Figure 12:
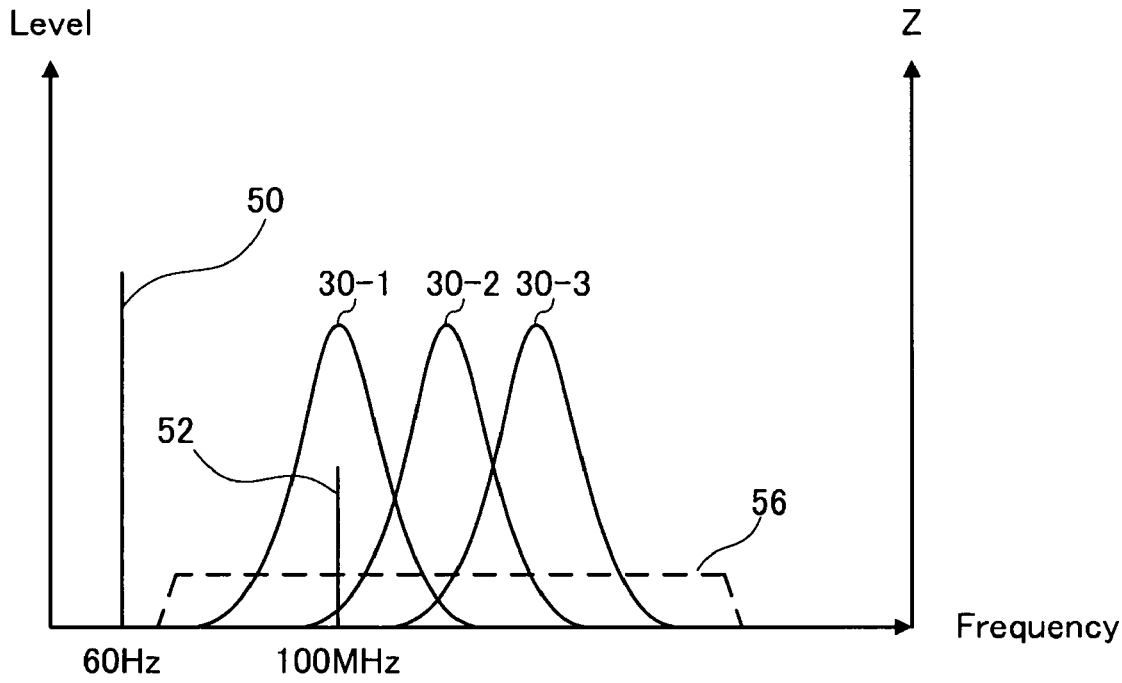
FIG. 12 is a characteristic drawing showing frequency characteristics of the impedance components shown in FIG. 11.

FIG. 12 is a characteristic drawing showing frequency characteristics of the impedance components shown in FIG. 11. As shown in FIG. 12, the static electricity noise 52 has a narrowband frequency characteristic. However, since the abnormal electrical discharge element 56 has a wideband frequency characteristic, it is determined to be the abnormal electrical discharge when all the impedance components 30-1 to 30-3 detect the signals, and to be the static electricity noise when one or more of the impedance components 30-1 to 30-3 did not detect the signal.

Figure 13:
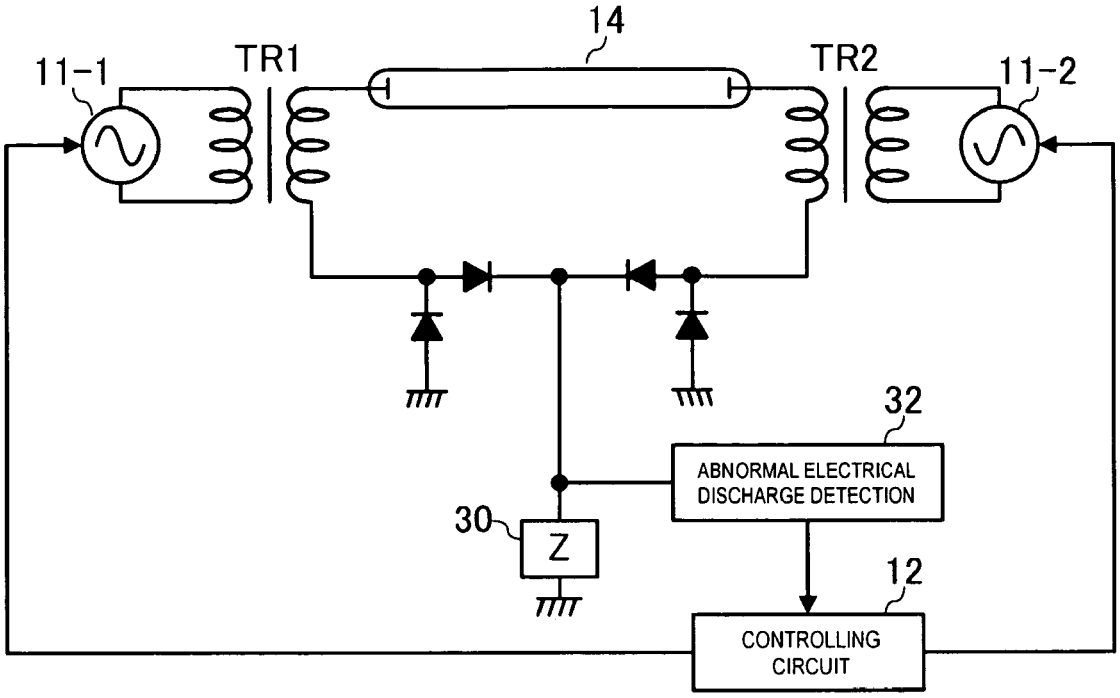
FIG. 13 is a circuit block diagram showing a configuration of the lamp driving device according to a sixth embodiment.

FIG. 13 is a circuit block diagram showing a configuration of the lamp driving device according to a sixth embodiment.

The lamp driving device shown in FIG. 13 has a configuration applicable to a differential driving method. The lamp driving device has a differential drive composition in which a differential motion voltage of a counter electrode is applied to a lamp 14 by arranging AC power supplies 11-1 and 11-2 which correspond to a switching circuit in FIG. 1 and a pair of transformers TR1 and TR2 respectively at both ends of the lamp 14.

In the differential composition as described above, the impedance component 30 is arranged on an earth line of the transformers TR1 and TR2 in series configuration via a diode bridge as shown in the same drawing, and a potential difference of the both ends of the impedance component is supplied to the abnormal electrical discharge detection circuit 32, whereby generation of the abnormal electrical discharge and a protection operation on the basis of the detected signal is carried out. In this configuration, the impedance component 30 can be commonly used between both electrodes of the differential.

Figure 14:
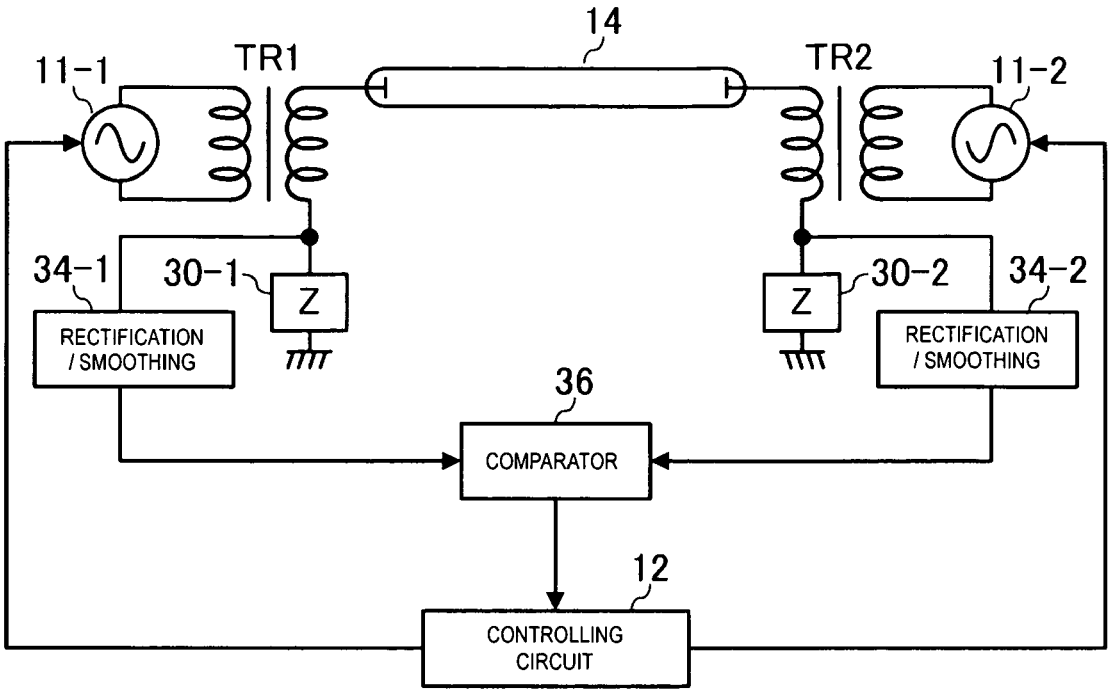
FIG. 14 is a circuit block diagram showing a configuration of the lamp driving device according to a seventh embodiment.

FIG. 14 is a circuit block diagram showing a configuration of the lamp driving device according to a seventh embodiment. The lamp driving device shown in FIG. 14 has a configuration in which the impedance components are arranged at the both electrodes of the differential. Other configurations are the same as FIG. 13.

In the lamp driving device, the impedance components 30-1 and 30-2 are arranged respectively on the high pressure line of the transformer TR1 and the high pressure line of the transformer TR2, and the potential difference at both ends of the respective impedance components are detected respectively by the rectification/smoothing circuits 34-1 and 34-2.

The outputs of the rectification/smoothing circuits are supplied to the common comparator 36, and when an output from one of the rectification/smoothing circuits exceeds a predetermined threshold value, a protection operation is performed.

Since the abnormal electrical discharge element and other noise elements can be discriminated, the foregoing embodiments may be applied to various devices which are liable to be affected by the noise is expected.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. A lamp driving device having a secondary closed-loop formed on a secondary side of a transformer, and a lamp arranged on the closed-loop in series configuration, comprising:

an impedance component arranged on the closed-loop in series configuration;

a unit that detects a potential difference across the impedance component; and a unit that carries out a protection operation on the basis of the detected potential difference when the detected potential difference exceeds a threshold.

2. The device of claim 1, further comprising:

a lighting control unit that controls lighting of the lamp; and a protection circuit that detects an abnormality of the closed-loop and gives an instruction to stop a lighting operation to the lighting control unit.

3. A lamp driving device having a secondary closed-loop formed on a secondary side of a transformer, and a lamp arranged on the closed-loop in series configuration, comprising:

an impedance component arranged on the closed-loop in series configuration;

a detection unit configured to detect a potential difference generated across the impedance component;

a comparison unit configured to compare the potential difference to a reference value; and a controlling unit configured to detect an abnormal electrical discharge based on the result of comparison and carry out a protection operation when the detected potential difference exceeds the reference value.

4. The device of claim 3, wherein the detection unit is further configured to rectify the voltage waveform outputted as the potential difference.

5. A lamp driving device having a secondary closed-loop formed on a secondary side of a transformer, and a lamp arranged on the closed-loop in series configuration, comprising:

an impedance component arranged on the closed-loop in series configuration;

means for detecting a potential difference generated across the impedance component;

means for comparing the potential difference to a reference value; and means for detecting an abnormal electrical discharge based on the result of comparison and carry out a protection operation when the detected potential difference exceeds the reference value.

* * * * *

UNITED STATES PATENT AND TRADEMARK OFFICE

CERTIFICATE OF CORRECTION

PATENT NO. : 7,439,689 B2
APPLICATION NO. : 11/521867
DATED : October 21, 2008
INVENTOR(S) : Honda et al.

It is certified that error appears in the above-identified patent and that said Letters Patent is hereby corrected as shown below:

At Column 2, Line 34, please delete "on," and insert therefore, --on--.

At Column 2, Line 67, after "where" please insert --the respective--.

At Column 3, Line 8, after "on" please insert --both--.

At Column 3, Line 32, after "at the" please insert --both--.

At Column 7, Line 9, please delete "FIG. 5 in the .....discharge." and insert the same after "G in" on Col. 7, line 8 as continuation of the same paragraph.

Signed and Sealed this

Twenty-third Day of June, 2009

John Doll

JOHN DOLL
*Acting Director of the United States Patent and Trademark Office*